US005257941A

United States Patent [19]

Lwee et al.

[11] Patent Number: 5,257,941

[45] Date of Patent: Nov. 2, 1993

[54] CONNECTOR AND ELECTRICAL CONNECTION STRUCTURE USING THE SAME

[75] Inventors: Nai Hock Lwee, Fremont, Calif.; Meng K. Kan, Singapore, Singapore

[73] Assignee: E. I. Du Pont de Nemours and Company, Wilmington, Del.

[21] Appl. No.: 929,453

[22] Filed: Aug. 14, 1992

[30] Foreign Application Priority Data

Aug. 15, 1991 [JP] Japan ..... 3-205316

[51] Int. Cl.[5] ..... H01R 9/09

[52] U.S. Cl. ..... 439/65; 439/82; 439/283; 439/589; 439/936

[58] Field of Search ..... 439/65, 74, 75, 82, 439/276, 283, 519, 521, 587, 589, 606, 875, 908, 926, 934, 936

[56] References Cited

U.S. PATENT DOCUMENTS

| | | | |
|---|---|---|---|
| 3,208,026 | 9/1965 | Ruehlemann | 339/17 |
| 4,545,632 | 10/1985 | Maier et al. . | |
| 4,550,962 | 11/1985 | Czeschka | 339/17 LC |
| 4,645,277 | 2/1987 | Kikuchi et al. | 339/17 LM |
| 4,645,280 | 2/1987 | Gordon et al. . | |
| 4,684,183 | 8/1987 | Kinoshita et al. . | |
| 4,781,601 | 11/1988 | Kuhl et al. . | |
| 4,804,330 | 2/1989 | Makowski et al. | 439/283 |
| 4,806,106 | 2/1989 | Mebane et al. . | |
| 4,861,272 | 8/1989 | Clark . | |
| 4,871,328 | 10/1989 | Wright et al. | 439/589 |
| 4,895,532 | 1/1990 | Bogese, II . | |
| 4,898,546 | 2/1990 | Elco et al. | 439/608 |
| 4,900,258 | 2/1990 | Horatuck et al. | 439/65 |
| 4,900,276 | 2/1990 | Doutrich | 439/82 |
| 4,932,873 | 6/1990 | La Shier | 439/76 |
| 4,948,379 | 8/1990 | Evans . | |
| 4,950,168 | 8/1990 | Watanabe et al. . | |
| 4,958,260 | 9/1990 | Kobayashi et al. . | |
| 5,032,085 | 7/1991 | Alwine et al. | 439/936 |
| 5,090,912 | 2/1992 | Zell | 439/82 |
| 5,096,428 | 3/1992 | Lwee et al. | 439/521 |
| 5,098,311 | 3/1992 | Roath et al. | 439/65 |

FOREIGN PATENT DOCUMENTS

| | | | |
|---|---|---|---|
| 0112476 | 11/1983 | European Pat. Off. . | |
| 2618630 | 1/1989 | France | 439/77 |
| 0278786 | 11/1990 | Japan | 439/77 |

*Primary Examiner*—Paula A. Bradley

*Attorney, Agent, or Firm*—Woodcock Washburn Kurtz Mackiewicz & Norris

[57] ABSTRACT

A relatively compact profile hard disc drive package is disclosed in which an clean room zone internal to the drive casing may be sealed despite the presence of a linking connector extending from the package. A cutout is provided in the casing and a connector body is fitted into the cutout so that the connector does not project beyond the surface of the casing. The connector has pins that are mated to a receptacle connector located within the casing and other pins that are mated to a receptacle connector on the exterior of the casing. The cutout is sealed by a sealant that is received between projections extending from the body of the connector.

6 Claims, 8 Drawing Sheets

CONNECTOR AND ELECTRICAL CONNECTION STRUCTURE USING THE SAME

BACKGROUND OF THE INVENTION

1. Field of the Invention

The present invention relates to a connector and electrical connection structure using the connector and, in particular, to a connector and electrical connection structure for an electronic apparatus requires an airtight, thin and compact structure.

2. Description of the Related Art

There is a growing demand for greater reduction in the size of electronic apparatus equipped with a hard disc drive (HDD), such as for use in laptop or notebook computers.

Generally, the casing of the hard disc drive contains a hard disc and its spindle motor as well as a read/write head and its associated drive mechanism. Due to the downsizing of hard disc drive, the casing is located in the proximity of a drive circuit board for driving the motor and head. The motor and head in the casing are electrically connected to the drive circuit board outside the casing by means of a connector projecting from an upper or lower portion of the casing.

Not only must the interior of the casing of the hard disc drive be initially free of fine dust particles (i.e., define a "clean room zone") but must remain so in order to permit proper functioning of the hard disc. In the present structure including the connector externally projected from the clean room zone of the hard disc drive, sealing cannot be achieved at the projection site of the connector. It is, thus, not possible to maintain the clean room zone airtight.

Moreover, the connector projected from the casing prevents the reduction of the height of the hard disc drive.

In view of the foregoing it is believed advantageous to provide a connector for use with a hard disc drive or any other apparatus in which the interior of the casing of the apparatus must be sealed to maintain an airtight state. It is also object of the present invention to provide an electric connection structure using the connector which can lower its height despite the presence of the connector.

SUMMARY OF THE INVENTION

In one aspect the present invention relates to a connector for electrically connecting a connector within a sealed area with a second connector located outside the sealed area, the connector comprising a unitary body made of an insulating material and having a plurality of connection pins bent in a U-shaped configuration. Each connection pin having a first pin section and a second pin section. The first and the second pin sections extend from the body and are respectively matable with the first and the second connector. Each connection pin also includes an arch section that joins the first and second pin sections. A portion of the arch section adjacent to the first pin section extend from the body with the remainder of the arch section is buried within the body. The body has a plurality of projections integrally extending therefrom such that the exposed portions of the arch sections and projections of the body are arranged in an alternate relation to each other. The projections serve as guide members for positioning a sealant that seals the exposed portion of each arch section.

In another aspect the present invention relates to an electrical connection structure comprising a casing having a boundary wall with a cutout therein, a first receptacle connector located within the casing that communicates with the opening, a second receptacle connector located outside the casing; and a linking connector as set forth above for connecting the first receptacle connector to the second receptacle connector. Both the cutout in the boundary wall and the linking connector have a height dimension d so that when the first connection pin sections of the linking connector is mated with the first receptacle connector the overall height of the casing is not increased.

The electrical connection structure of the present invention may be particularly useful for a hard disc drive (HDD) package. In this instance, the casing corresponds to a casing for holding the hard disc drive, the first receptacle connector is connected by flexible lines with the disc drive spindle motor and its read/write head drive mechanism, while the second receptacle connector is connected to a drive circuit board for driving the motor and head drive mechanism.

According to the connector of the present invention, the sealing area is sealed by the sealant, enabling the sealed area to be maintained in an airtight fashion.

BRIEF DESCRIPTION OF THE DRAWINGS

The invention will be more fully understood from the following detailed description, taken in connection with the accompanying drawings, which form a part of this application, in which.

DETAILED DESCRIPTION OF THE PREFERRED EMBODIMENTS

Figure 1:
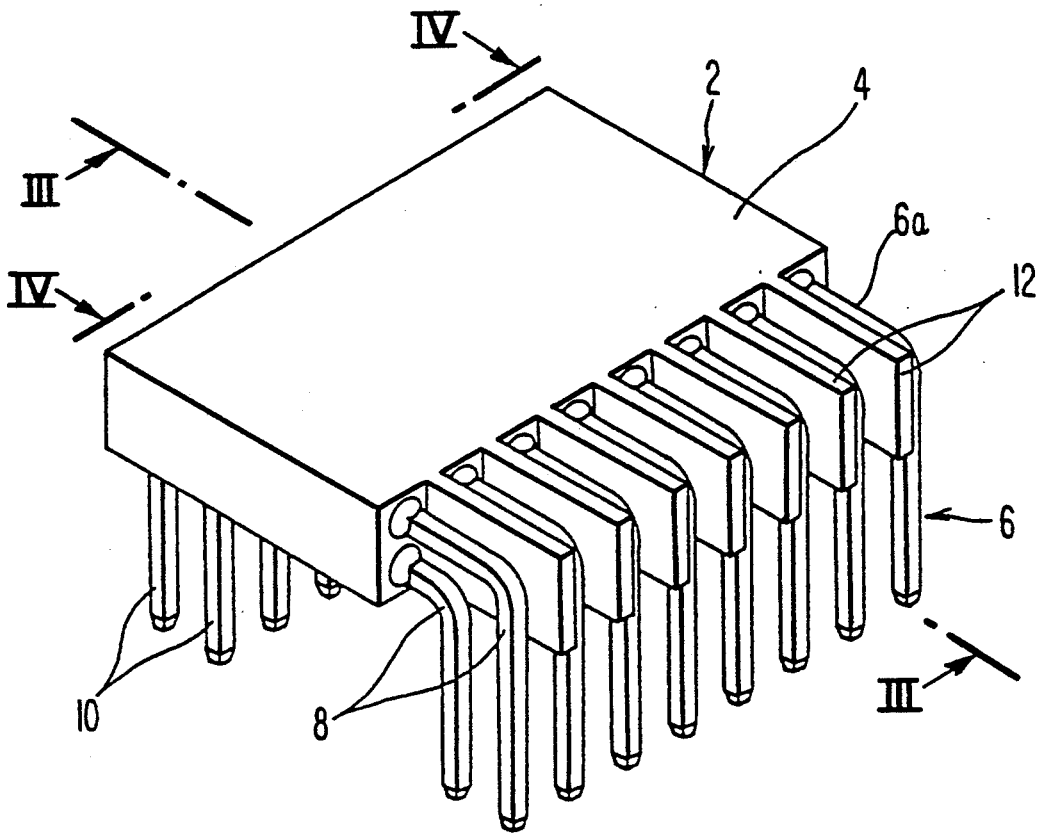
FIG. 1 is a perspective view showing a connector according to a first embodiment of the present invention.

Throughout the following detailed description similar reference numerals refer to similar elements in all Figures of the drawings.

FIGS. 1 to 4 show a connector in accordance with a first embodiment of the present invention. In these Figures the connector 2 comprises a body 4 formed of an insulating material, such as a plastics material, and a plurality of metal connection pins 6. The body 4 together with the pins 6 are molded as one unit. As evident from FIG. 3 in particular, each connection pins 6 is bent into a U-shaped configuration to provide first and second connection pin sections 8 and 10, respectively, joined by an arch section 6a. The pin sections 8, 10 extend from the body 4. In addition a portion of the arch section 6a adjacent to the first pin section 8 extends from the body 4, while the remainder of the arch section 6a (including the portion adjacent to the second pin section 10) is buried in the body 4.

Figure 2:
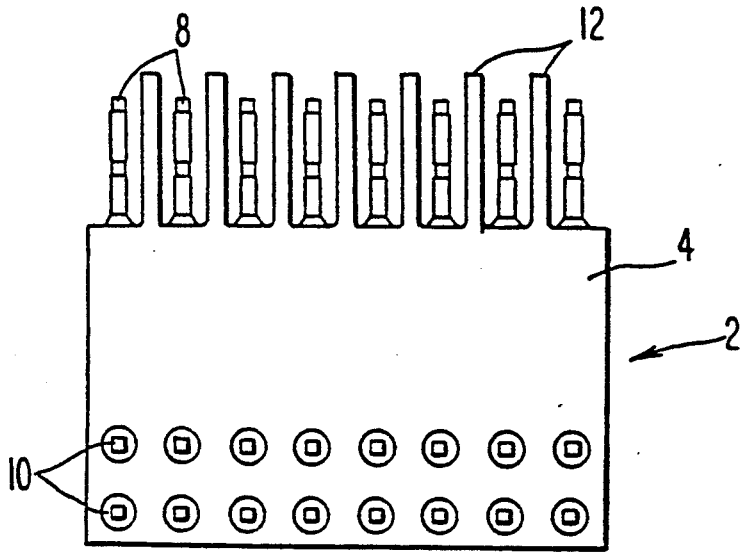
FIG. 2 is a bottom view showing the connector of FIG. 1.
Figure 3:
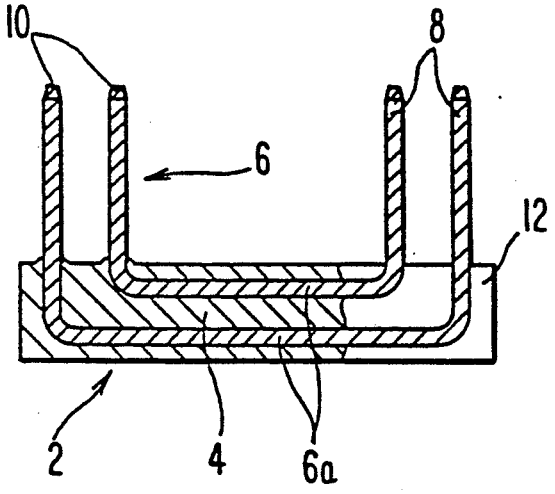
FIG. 3 is a cross sectional view in the direction of the section arrows III—III in FIG. 1.
Figure 4:
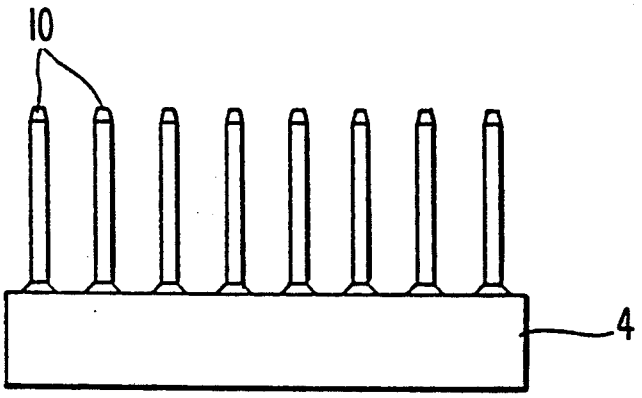
FIG. 4 is an elevational view taken along view line IV—IV in FIG. 1.
Figure 8:
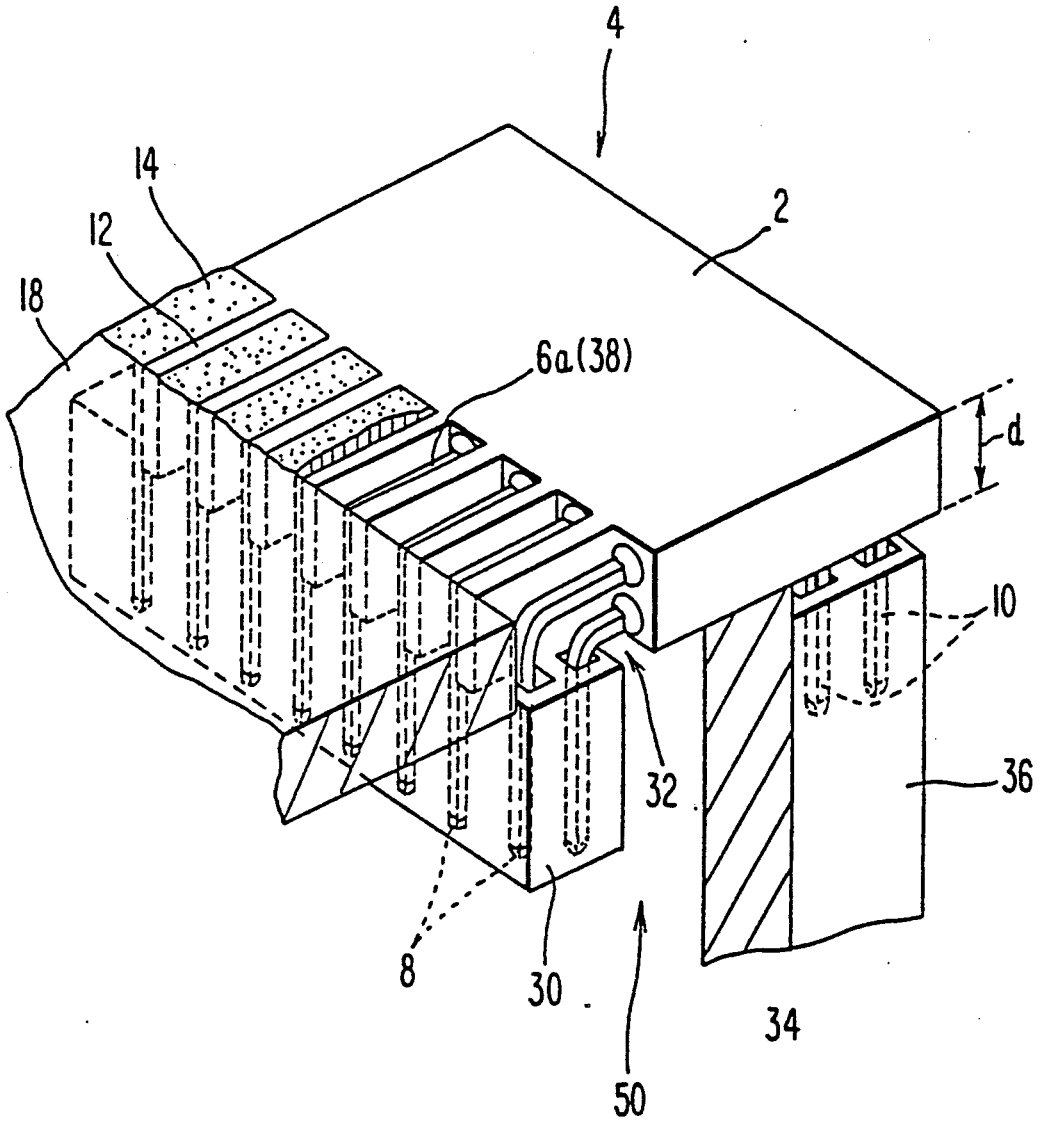
FIG. 8 is a perspective view showing the recesses for sealing the exposed area of connection pins in the connector of FIG. 7.

It is preferred that, as shown in FIGS. 1 and 2, a plurality of ribs 12 project from the side surface of the body 4 from which extend the first connection pins 8. As will be developed the ribs 12 serve as guide members for positioning a sealant 14 (FIG. 8). As shown in FIG. 1, the ribs 12 are comprised of plate-like members alternately arrayed between the respective adjacent exposed portions of the arch sections 6a. The core portion of the body 4 is so reinforced that, during the period of a molding step, the U-shaped connection pins are readily inserted using an appropriate hand tool.

The first pin sections 8 of the connector 2 are connectable to a connection section (e.g., a receptacle connector) located within a sealed area, for example, to a receptacle connector connected to a spindle motor and read/write head drive mechanism within a clean room area 50 of a hard disc drive (HDD). The second pin sections 10 are matably connectable to a connection section (e.g., a receptacle connector) located outside the sealed area, for example, to a drive circuit board outside the casing of a disc drive. In this case the arch section 6a is placed at a boundary between the outside and the inside of a sealed area, for example, at a side wall of the clean room zone. After the first connection pin section 8 is connected, the exposed portion of the arch section 6a is sealed by the sealant 14.

The positions of the connections pins 8 and 10 may be reversed, in which case the sealant 14 is coated to the second connection pins 10.

FIGS. 5 to 9 show an electrical connection structure according to a second embodiment. In this embodiment the spindle motor and read/write drive mechanism in a hard disc drive are connected to their drive circuit board by the connector 2 of the first embodiment (FIGS. 1 to 4) serving as a linking connector.

Figure 5:
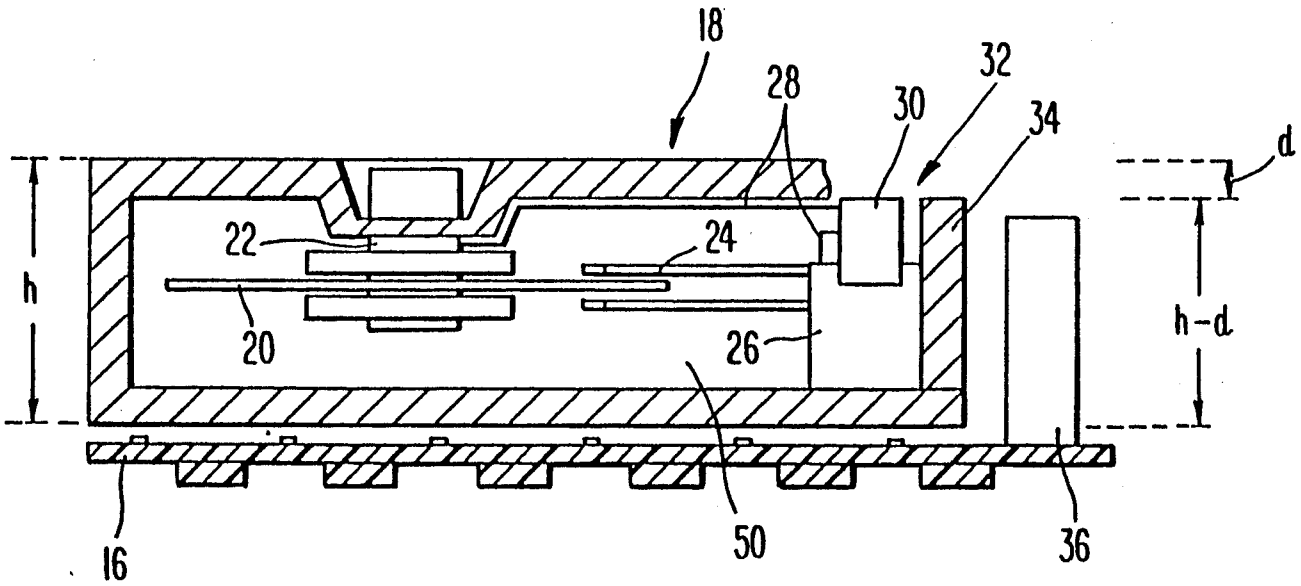
FIG. 5 is a side view diagrammatically showing a hard disc drive package according to a second embodiment of the present invention, that is, a view, partly broken away, showing a major section of its structure before the connector is mounted thereto.

FIG. 5 shows a hard disc drive before the linking connector 2 is mounted thereto. In FIG. 5 a casing 18 is arranged above a drive circuit board 16. The casing 18 is a cast product. A hard disc 20 and its spindle motor 22 as well as a read/write head 24 and its drive mechanism 26 are arranged in a clean room zone 50 of the casing 18.

Flexible cables 28 for drive signal transmission extend from the motor 22 and head drive mechanism 26. A receptacle connector 30 is attached to these cables 28. The cables 28 and receptacle connector 30 are arranged in the casing 18.

A cutout 32 which is rectangular as viewed from above the casing 18 is provided at the end (the right end in FIG. 5) of the casing 18. The clean room zone 50 is sealed except for the rectangular cutout. The cutout 32 has a depth dimension d so that the casing 18 at the location of the rectangular cutout 32 is lower than the height h of the remainder of the casing 18 by the depth dimension d. The connector body 4 (FIG. 1) also has a height dimension d.

A top-entry type receptacle connector 36 is arranged outside the casing 18. The receptacle connector 36 is attached to a circuit board 16 such that its longitudinal portion extends substantially parallel to the side wall 34.

Figure 6:
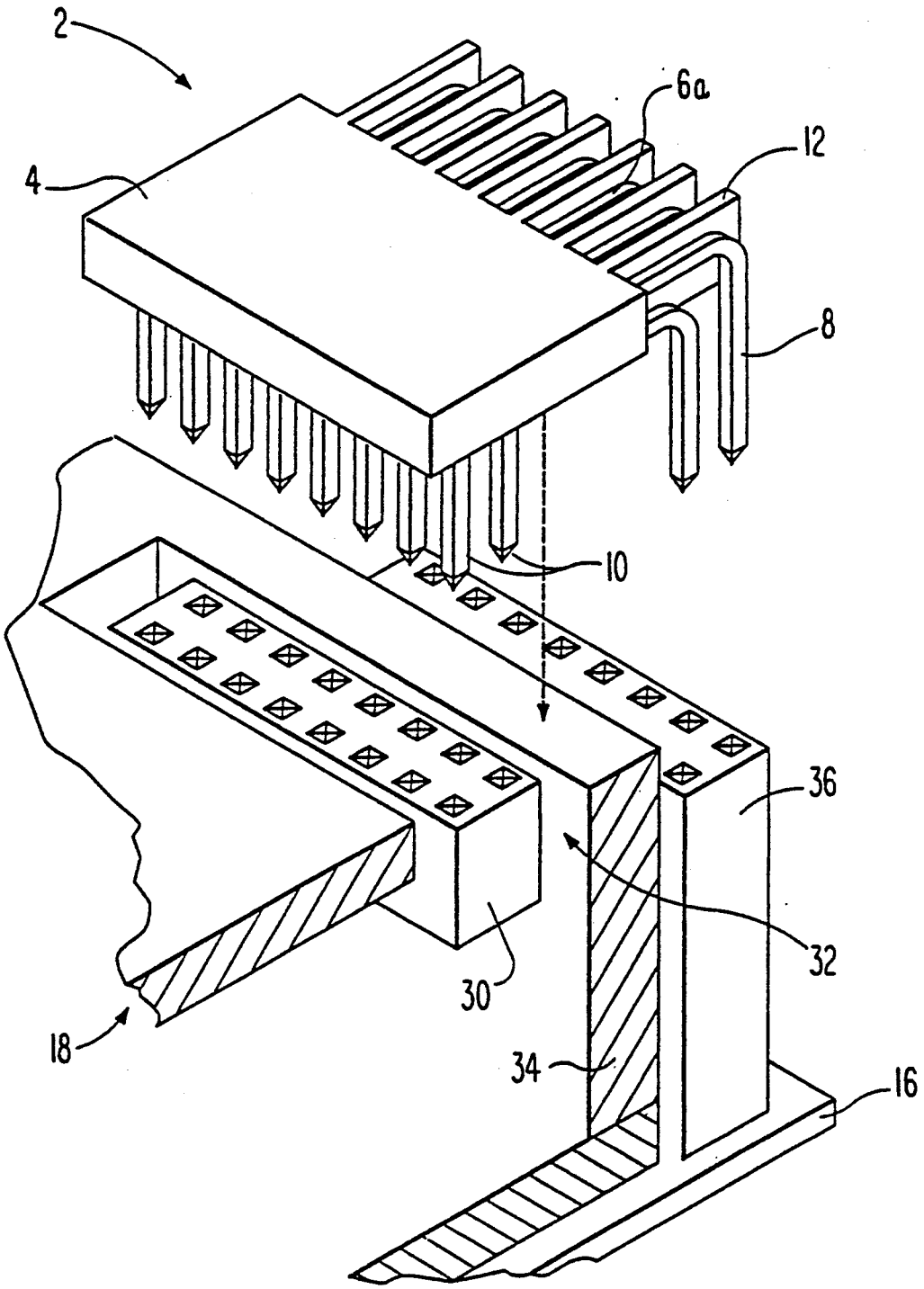
FIG. 6 is an exploded, perspective view showing a state in which the connector is mounted on the hard disc drive package.
Figure 7:
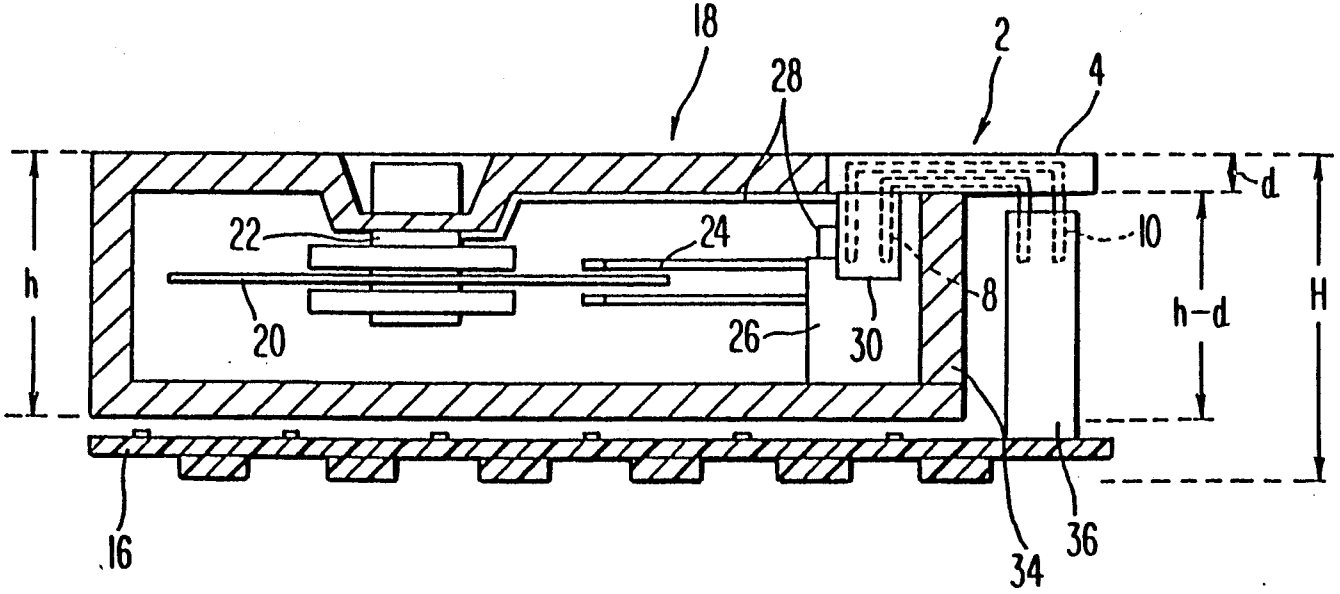
FIG. 7 is a side view showing a major section of the hard disc drive package of FIG. 5 to which the connector is attached.

FIG. 6 illustrates the connector 2 when mounted on the hard disc drive. As shown in FIG. 6 the side of the body 4 from which the first pin sections 8 extend is fitted into the cutout 32 of the casing 18. The first pin sections 8 are mated to the receptacle 30 in the casing 18 and the second connection pin section 10 is mated into the receptacle connector 36. As shown in FIG. 7 the motor 22 is thus electrically connected to the circuit board 16 through the cable 28, receptacle connector 30, connector 2 and receptacle connector 36.

As shown in FIG. 8 the exposed portion 38 of the arch section 6a in the cutout 32 is sealed by the sealant 14. The casing 18, and especially the clean room zone 50 therein, are sealed against the entry of dust and fine particles despite the presence of the linking connector 2.

The depth d of the cutout 32 equals to the thickness d of the connector body 4 and the connector body 4 does not project from the upper surface of the casing 18. Since the height h of the casing is not increased with the connector 2 mounted in place the hard disc drive can be so designed that its entire overall package height H can be made very compact. It is thus possible to achieve a thinner, very portable hard disc drive for use in a laptop or a notebook computer when the drive is incorporated therein.

Figure 9:
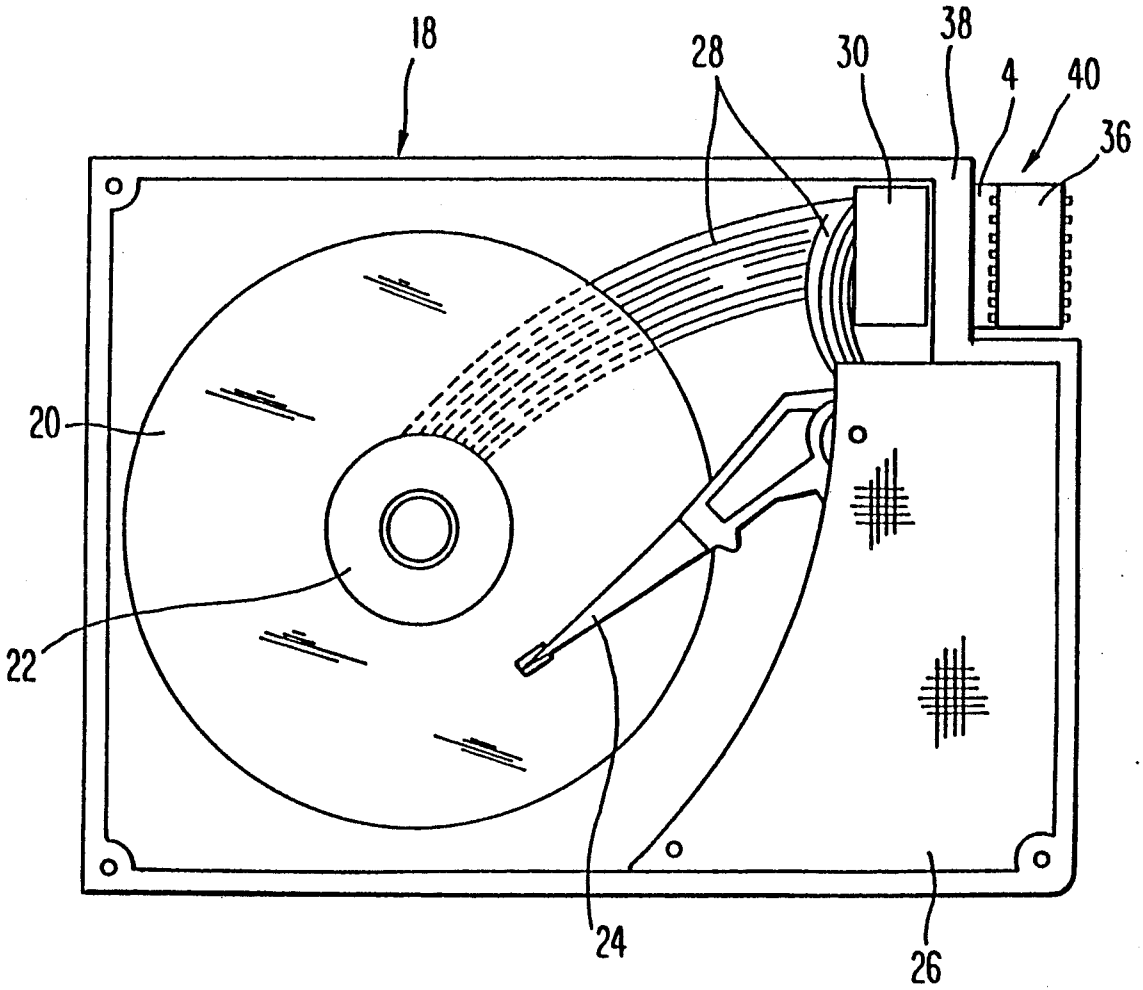
FIG. 9 is a bottom view showing a hard disc drive package of FIG. 7 with a drive circuit board omitted.

According to the present invention, it is preferred that, in order to reduce the width of the hard disc drive package the casing 18 should be configured as shown in FIG. 9. The corner 38 of the casing 18 is internally recessed, as at 40, in the neighborhood of the receptacle connector 36. By arranging the receptacle connector 36 at that corner recess the package for the hard disc drive exhibits a small width.

Figure 10:
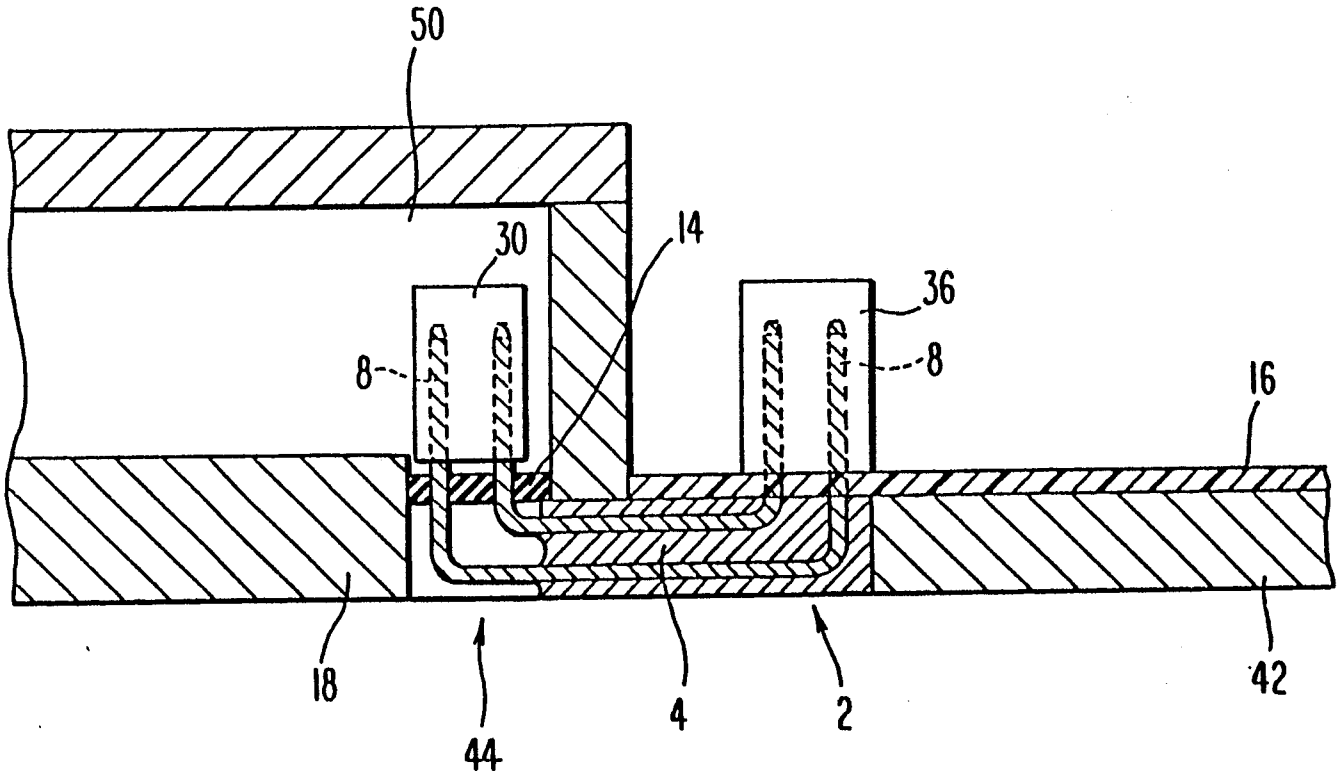
FIG. 10 is a side view showing a major section, partly broken away, of a hard disc drive package according to a modification of the second embodiment of the present invention.

FIG. 10 shows a modification to the electric connection structure earlier discussed. In the embodiment of FIG. 10 the connector 2 is similar to those earlier discussed, except that receptacle connectors 30 and 36 are of a bottom-entry type. A plate-like casting member 42 integral with the casing 18 extends from a lower side of the casing 18. A board 16 is provided on the upper surface of the casting member 42. A cutout 44 is provided between the casing 18 and the casting member 42 with the connector 2 fitted into the cutout 44. The first connection pin sections 8 of the connector 2 are inserted into the receptacle connector 30 in the casing 18 and the second connection pin sections 10 are inserted into the receptacle connector 36 through the board 16. The connector body 4 is bonded by the sealant 14 to the casing 18 at a location of the cutout 44 to seal the cutout 44 of the casing 18.

Again, in this embodiment, the hard disc drive package is so designed that the entire overall package height H is achieved.

It should be understood that the electrical connection structure according to the present invention is not restricted to the package for a hard disc drive, but can be used wherever the sealed integrity of a package is required.

Those skilled in the art, having the benefit of the teachings of the present invention as hereinabove set forth, may effect modifications thereto. These modifications are to be construed as lying within the contemplation of the present invention, as defined by the appended claims.

What is claimed is:

1. A linking connector for electrically connecting a first connector located within a sealed area with a second connector located outside the sealed area, the linking connector comprising:

a unitary body made of insulating material and having a plurality of connection pins bent in a U-shaped configuration, each connection pin having a first pin section extending from the body and matable with the first connector, a second pin section extending from the body and matable with the second connector, and an arch section joining the first and second pin sections, a portion of the arch section adjacent to the first pin section extending from the body with the remainder of the arch section being buried within the body.

2. The connector according to claim 1, wherein the body has a plurality of projections integrally extending therefrom such that the exposed portions of the arch sections and projections of the body are arranged in an alternate relation to each other.

3. An electrical connection structure comprising:

a casing having a boundary wall with a cutout therein, the cutout in the boundary wall having depth dimension d;

a first receptacle connector located within the casing, the first connector communicating with the opening;

a second receptacle connector located outside the casing; and a linking connector for connecting the first receptacle connector to the second receptacle connector, the linking connector comprising:

a unitary body made of insulating material and having a having a height dimension d, the body having a plurality of connection pins bent in a U-shaped configuration, each connection pin having a first pin section extending from the body and being matable with the first receptacle connector, a second pin section extending from the body and being matable with the second receptacle connector, and an arch section joining the first and second pin sections, a portion of the arch section adjacent to the first pin section extending from the body with the remainder of the arch section being buried within the body, in use, the body being located in the cutout in the boundary wall with the first pin sections extending into the casing into mated engagement with the first receptacle connector, the second pin sections being in mated engagement with the second receptacle connector, the exposed portions of the arch sections of the linking connector being sealed by a sealant.

4. The electrical connection structure according to claim 3, wherein the casing holds a hard disc drive, the first receptacle connector is provided at flexible connection lines for signal transmission extending from a spindle motor and read/write head drive mechanism and the second receptacle connector is attached to a drive circuit board for driving the spindle motor and read/write head drive mechanism.

5. The connector structure according to claim 3, wherein the body of the linking connector has plurality of projections integrally extending therefrom such that the exposed portions of the arch sections and projections of the body are arranged in an alternate relation to each other.

6. The electrical connection structure according to claim 5, wherein the casing holds a hard disc drive, the first receptacle connector is provided at flexible connection lines for signal transmission extending from a spindle motor and read/write head drive mechanism and the second receptacle connector is attached to a drive circuit board for driving the spindle motor and read/write head drive mechanism.

* * * * *